US005832751A

United States Patent [19]

Belluzzi

[11] Patent Number: 5,832,751

[45] Date of Patent: Nov. 10, 1998

[54] IMPREGNATING MACHINE FOR SURFACE IMPREGNATING HIDES OR SIMILAR PRODUCTS

[75] Inventor: Lino Belluzzi, Vicenza, Italy

[73] Assignee: Elitas S.n.c. di Belluzi Lino & C., Italy

[21] Appl. No.: 894,125

[22] PCT Filed: Feb. 21, 1996

[86] PCT No.: PCT/IT96/00031

§ 371 Date: Aug. 22, 1997

§ 102(e) Date: Aug. 22, 1997

[87] PCT Pub. No.: WO96/26294

PCT Pub. Date: Aug. 29, 1996

[30] Foreign Application Priority Data

Feb. 24, 1995 [IT] Italy ..... TO95A0137

[51] Int. Cl.[6] ..... C14C 11/00; C14C 15/00

[52] U.S. Cl. ..... 69/32; 60/44; 60/202

[58] Field of Search ..... 69/21, 29, 30, 69/32, 47; 68/43, 44, 45, 202; 8/150.5; 118/245, 248, 249, 244

[56] References Cited

U.S. PATENT DOCUMENTS

| | | | |
|---|---|---|---|
| 5,235,829 | 8/1993 | Belluzzi | 69/32 |
| 5,653,130 | 8/1997 | Dokoupilova et al. | 69/32 |

FOREIGN PATENT DOCUMENTS

| | | |
|---|---|---|
| A 0484740 | 5/1992 | European Pat. Off. . |
| A 2532953 | 3/1984 | France . |
| A 1435304 | 4/1969 | Germany . |

*Primary Examiner*—Michael A. Neas
*Attorney, Agent, or Firm*—Oliff & Berridge, PLC

[57] ABSTRACT

An impregnating machine (1, 28) for surface impregnating hides (2) or similar products wherein an endless conveyor belt (3), with a transportation branch (5) traveling in a given direction (6), and a conveyor (16), presenting a number of endless belts (17), define a feed channel (19) for the hides (2); the feed channel (19) extending substantially up to a narrow passage (13) for the conveyor belt (3) and the hides (2); and the passage (13) being defined between an impregnating roller (11) and a deflecting member (7) facing the impregnating roller (11) and such as to impart to the transportation branch (5) of the conveyor belt (3) a radius of curvature (R1) equal to a relatively small fraction of the radius (R2) of the impregnating roller (11).

10 Claims, 2 Drawing Sheets

IMPREGNATING MACHINE FOR SURFACE IMPREGNATING HIDES OR SIMILAR PRODUCTS

TECHNICAL FIELD

The present invention relates to an impregnating machine for surface impregnating hides or similar products.

In particular, the present invention relates to an impregnating machine for surface impregnating hides or similar products, the machine being of the type comprising conveying means defining a given path for the hides, and for feeding the hides in a given direction along said path; a cylindrical impregnating roller rotating in the opposite direction to said given direction, and presenting a given radius and a cylindrical outer surface; and a deflecting member for imparting a given curvature to a portion of said path; said path portion being located facing the periphery of the impregnating roller, and defining, with the periphery of the impregnating roller, a narrow passage for the hides; and said conveying means being, upstream from said passage, continuous conveying means arranged on opposite sides of said path to define a feed channel for the hides.

BACKGROUND ART

In EP-A-0 484 740, an impregnating machine is disclosed of the type described above, and wherein a hide conveying member, comprising a belt and defining the aforementioned advancement path for the hides, is wound about a deflecting roller defining the aforementioned deflecting member, and is positioned facing the impregnating roller to define therewith the aforementioned narrow passage for the hides.

The impregnating roller of EP-A-0 484 740 is so operated that, at the noted narrow passage, its periphery travels in the opposite direction to that of the conveying member.

Counter rotation of the impregnating roller in relation to the facing conveying member generates several problems stemming from the impregnating roller tending to push the hides back at the narrow passage.

In order to avoid the above, in the machine manufactured in accordance with EP-A-0 484 740 several precautions where taken. As a first precaution, in order to impart a better traction to the hides, the deflecting roller was chosen as large in diameter as possible so as to keep the traction imparted by the conveying member to each hide at the noted narrow passage as aligned as possible to the portion of the hide arranged upstream from the narrow passage. As a second precaution, the noted feed channel for the hides was interrupted a predetermined distance from the narrow passage to allow insertion, between the outlet of the feed channel and the narrow passage, of a guiding blade an edge of which was arranged substantially at the narrow passage.

The above precautions notwithstanding, the machines manufactured in accordance with EP-A-0 484 740 proved to be somehow unsatisfactory owing to the hides tending to jam between the guiding blade and the outlet of the feed channel.

DISCLOSURE OF INVENTION

It is an object of the present invention to provide an impregnating machine wherein the impregnating roller is operated in the opposite direction to that in which the hides travel, but which enables the hides to be fed smoothly and safely onto the impregnating roller.

According to the present invention, there is provided an impregnating machine for surface impregnating hides or similar products, the machine comprising conveying means defining a given path for the hides, and for feeding the hides in a given direction along said path; a cylindrical impregnating roller rotating in the opposite direction to said given direction, and presenting a given radius and a cylindrical outer surface; and a deflecting member for imparting a given curvature to a portion of said path; said path portion being located facing the periphery of the impregnating roller, and defining, with the periphery of the impregnating roller, a narrow passage for the hides; said conveying means being, upstream from said passage, continuous conveying means arranged on opposite sides of said path to define a feed channel for the hides; and the machine being characterized in that said path portion presents a radius of curvature equal to a relatively small fraction of the radius of the impregnating roller; said feed channel extending substantially up to said passage.

Said conveying means preferably comprise an endless conveyor belt presenting a transportation branch traveling in said given direction, the transportation branch defining said path portion and extending about the deflecting member to assume said given radius of curvature; and a conveyor cooperating with said transportation branch upstream from said deflecting member to define, with the transportation branch, said feed channel.

According to a preferred embodiment of the above machine, said transportation branch comprises two contiguous portions in series in said given direction, and of which a first is located upstream and a second downstream from said deflecting member; said two portions forming a given obtuse angle; and the conveyor cooperating with said first portion.

More specifically, said conveyor preferably comprises a number of endless, side by side belts; at least one transmission pulley for each said belt; and a deflecting block adjacent to said passage; the deflecting block being comb-shaped, and comprising a number of teeth extending parallel to said given direction; and each pair of adjacent teeth defining a fork for a respective said transmission pulley.

BRIEF DESCRIPTION OF THE DRAWINGS

Two non-limiting embodiments of the present invention will be described by way of example with reference to the accompanying drawings, in which.

BEST MODE FOR CARRYING OUT THE INVENTION

Figure 1:
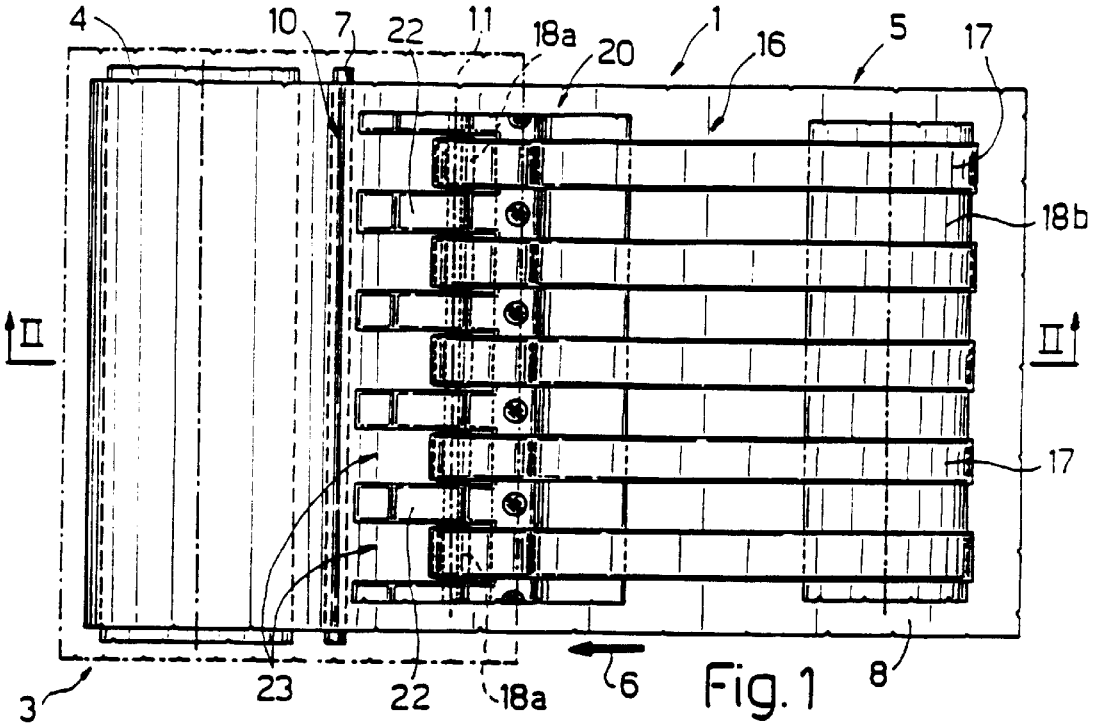
FIG. 1 shows a plan view, with parts removed for clarity, of a first preferred embodiment of the machine according to the present invention.
Figure 2:
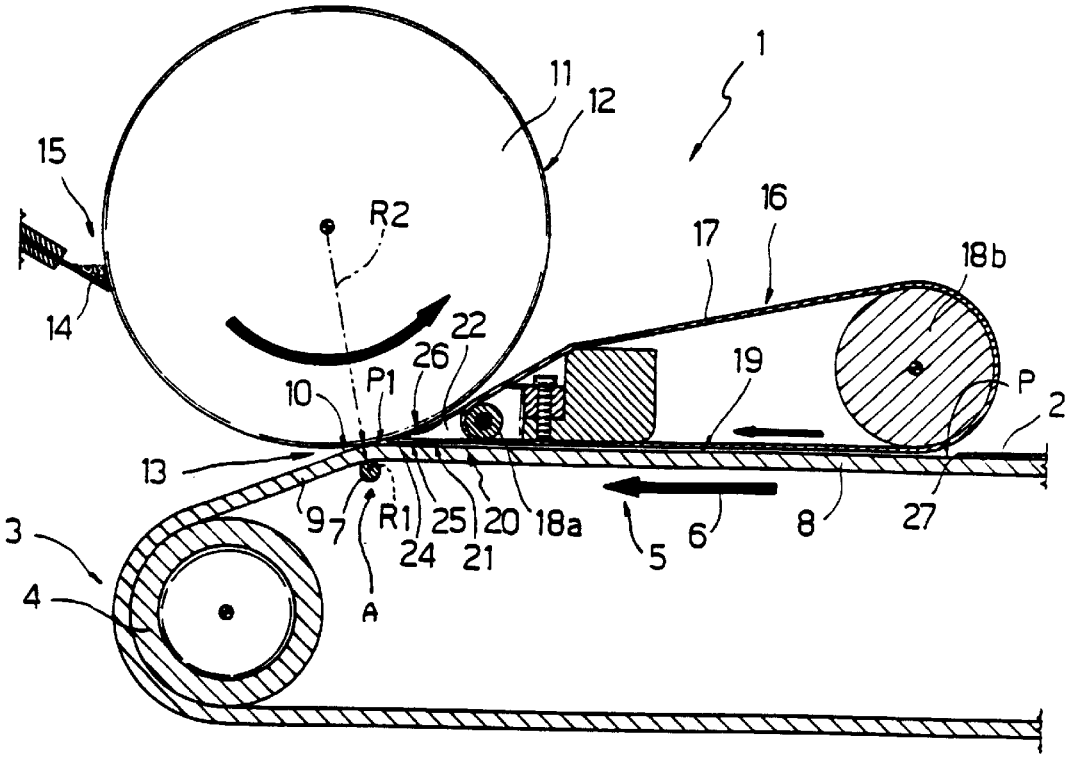
FIG. 2 shows a section along line II—II in FIG. 1.

Number 1 in FIGS. 1 and 2 indicates an impregnating machine for surface impregnating a succession of hides 2 or similar products, and which comprises a conveyor belt 3 looped about two pulleys 4 (only one shown) and presenting a transportation branch 5 for successively receiving hides 2 from a known feed device (not shown), and for feeding them along a path P in a given substantially horizontal direction 6.

Machine 1 also comprises a deflecting member 7 located inwards of belt 3 and cooperating with the inner surface of an intermediate portion of belt 3 so that said intermediate portion presents a given radius of curvature R1. More specifically, deflecting member 7 cooperates with transportation branch 5 on which it defines two contiguous portions 8 and 9 in series in direction 6 and respectively up- and downstream from member 7 to form a given obtuse angle A. Member 7 preferably, but not necessarily, comprises a transmission roller with a radius R1 and mounted parallel to pulleys 4, so that transportation branch 5 is substantially in the form of an obtuse dihedron, the curved outer vertex 10 of which defines a curved portion P1 of path P, and forms, on belt 3, the boundary between contiguous portions 8 and 9.

Machine 1 also comprises a cylindrical impregnating roller 11 facing deflecting member 7, located outside belt 3, and presenting a much larger radius R2 than the radius of curvature R1 of portion P1. More specifically, radius R1 equals a relatively small fraction of radius R2.

Here and in what follows and, in particular, in the claims, the term "relatively small fraction" is used to indicate a fraction of the order of 1/10. In particular, in the shown embodiments, the above fraction has a value of about 1/20.

Roller 11 presents a cylindrical outer surface 12 defining, together with member 7, a narrow passage 13 for belt 3 and hides 2, and is powered in known manner (not shown) so that surface 12 travels in the opposite direction to direction 6 at passage 13, and carries a thin film (not shown) of dyeing liquid 14 applied in known manner to surface 12 by a known doctor blade 15 located upstream from passage 13 in the rotation direction of roller 11.

Machine 1 also comprises a conveyor 16 located upstream from deflecting member 7, and in turn comprising a number of side by side belts 17, each looped about at least two pulleys 18*a*, 18*b*, the second of which is common to all of belts 17. Conveyor 16 cooperates with portion 8 of transportation branch 5, with which it defines a channel 19 for feeding hides 2 and extending parallel to direction 6.

Conveyor 16 also comprises a deflecting block 20 adjacent to passage 13 and defining the output portion 21 of channel 19, which substantially extends up to passage 13. Block 20 is substantially comb-shaped, and comprises a number of teeth 22 for maintaining hides 2 firmly contacting belt 3, and which extend side by side and parallel to direction 6 along portion 21, and define respective forks 23, each housing in rotary manner a respective pulley 18*a*.

More specifically, each tooth 22 presents a free end 24 substantially at passage 13, and two surfaces 25 and 26 forming an acute angle; surface 25 is a flat surface facing transportation branch 5 with which it defines portion 21; and surface 26 is a curved surface facing and substantially tangent to surface 12 of roller 11.

Operation of machine 1 is immediately discernible from the foregoing description. One point to note, however, is that, since the free ends 24 of teeth 22 are such that output portion 21 of channel 19 extends substantially up to passage 13, and since surfaces 26 of teeth 22 are substantially tangent to surface 12 of impregnating roller 11, it is practically impossible for hides 2 or their front ends 27 (FIG. 2) to be pushed backwards by the friction produced by roller 11. In this connection, it should be pointed out that the friction between roller 11 and hides 2 is minimized by the diameter of deflecting member 7, the relatively small radius R2 of which forms a path P substantially in the form of a broken line, and minimizes the contact area between roller 11 and hides 2.

A further point to note is the stabilizing effect of channel 19 on the shape of each hide 2, which enables the front end 27 to be "propelled" at full speed into and past passage 13, with no danger of the normally thicker end 27 being jammed beneath roller 11 inside passage 13. The stabilizing effect of channel 19 on the shape of hides 2, combined with the small contact area between roller 11 and belt 3, i.e. the relatively small portion of portion P1 of path P along which roller 11 interacts with hides 2, enables hides 2 to travel rapidly through passage 13, without being pushed backwards by roller 11, once passage 13 is engaged by front ends 27.

Figure 3:
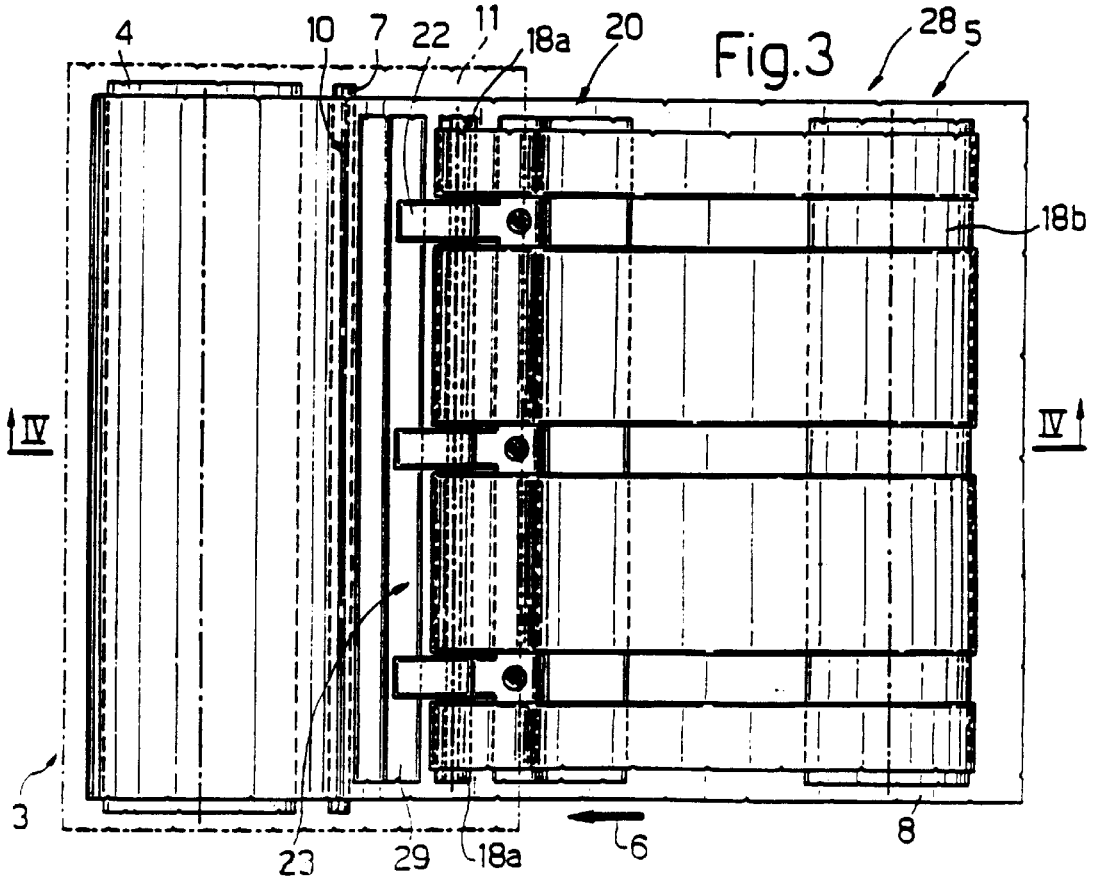
FIG. 3 shows a plan view, with parts removed for clarity, of a second preferred embodiment of the machine according to the present invention.
Figure 4:
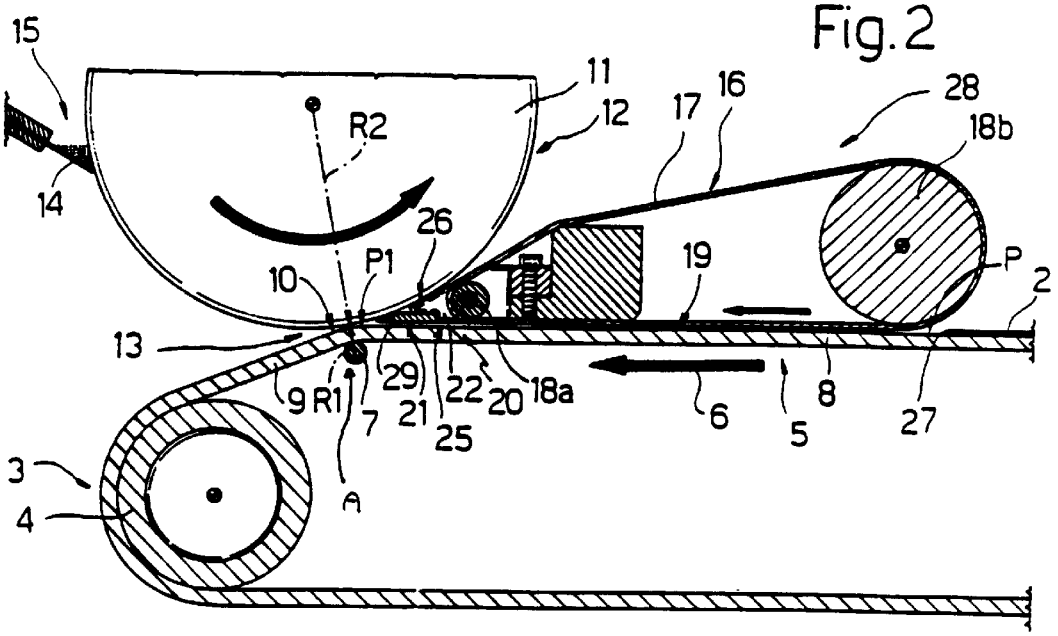
FIG. 4 shows a section along line IV—IV in FIG. 3.

The FIG. 3 and 4 variation relates to an impregnating machine 28 similar to machine 1, except that deflecting block 20 also comprises a plate 29 extending crosswise to the traveling direction 6 of hides 2, located facing portion 8 of transportation branch 5 immediately upstream from passage 13, and substantially tangent to surface 12 of roller 11. More specifically, plate 29 is fitted to teeth 22, of which it substitutes for respective ends 24, and is located between pulleys 18*a* and passage 13.

Machine 28 operates in exactly the same way as already described in connection with machine 1.

I claim:

1. An impregnating machine for surface impregnating hides, the machine comprising conveying means defining a given path for the hides, and for feeding the hides in a given direction along said path; a cylindrical impregnating roller rotating in the opposite direction to said given direction, and presenting a given radius and a cylindrical outer surface; and a deflecting member for imparting a given curvature to a portion of said path; said path portion being located facing the surface of the impregnating roller, and defining, with the surface of the impregnating roller, a narrow passage for the hides; and said conveying means being, upstream from said passage, continuous conveying means arranged on opposite sides of said path to define a feed channel for the hides; and the machine being characterized in that said path portion presents a radius of curvature equal to a relatively small fraction of the radius of the impregnating roller; said feed channel extending substantially up to said passage.

2. An impregnating machine as claimed in claim 1, characterized in that said radius of curvature is less than 1/10 of the radius of said impregnating roller.

3. An impregnating machine as claimed in claim 2, characterized in that said radius of curvature is about 1/20 of the radius of said impregnating roller.

4. An impregnating machine as claimed in claim 1, characterized in that said conveying means comprise an endless conveyor belt presenting a transportation branch traveling in said given direction, the transportation branch defining said path portion and extending about the deflecting member to assume said given radius of curvature; and a conveyor cooperating with said transportation branch upstream from said deflecting member to define, with the transportation branch, said feed channel.

5. An impregnating machine as claimed in claim 4, characterized in that said transportation branch comprises two contiguous portions in series in said given direction, and of which a first is located upstream and a second downstream from said deflecting member; said two portions forming a given obtuse angle; and the conveyor cooperating with said first portion.

6. An impregnating machine as claimed in claim 5, characterized in that said conveyor comprises a number of endless, side by side belts; at least one transmission pulley for each said belt; and a deflecting block adjacent to said passage; the deflecting block being comb-shaped, and comprising a number of teeth extending parallel to said given direction; and each pair of adjacent teeth defining a fork for a respective said transmission pulley.

7. An impregnating machine as claimed in claim 6, characterized in that said teeth present free ends substantially at said passage.

8. An impregnating machine as claimed in claim 6, characterized in that each said tooth presents two surfaces forming an acute angle; a first of said two surfaces being a flat surface facing said transportation branch and defining, with the transportation branch, an output portion of said feed channel; and a second of said two surfaces being a curved surface facing and substantially tangent to said outer surface.

9. An impregnating machine as claimed in claim 6, characterized in that said deflecting block also comprises a plate extending crosswise to said given direction, facing said first portion of said transportation branch immediately upstream from said passage, and substantially tangent to the outer surface of said impregnating roller; said plate being integral with said teeth and located between said pulleys and said passage.

10. An impregnating machine as claimed in claim 4, characterized in that said deflecting member is a transmission roller presenting a relatively small radius in relation to that of the impregnating roller, and such that said transportation branch is substantially in the form of an obtuse dihedron with a vertex at said passage.

* * * * *